US011488772B2

(12) United States Patent
Kawaguchi et al.

(10) Patent No.: US 11,488,772 B2
(45) Date of Patent: Nov. 1, 2022

(54) COIL COMPONENT AND METHOD OF MANUFACTURING THE SAME

(71) Applicant: TDK CORPORATION, Tokyo (JP)

(72) Inventors: Yuuichi Kawaguchi, Tokyo (JP); Masanori Suzuki, Tokyo (JP); Naoaki Fujii, Tokyo (JP)

(73) Assignee: TDK CORPORATION, Tokyo (JP)

( * ) Notice: Subject to any disclaimer, the term of this patent is extended or adjusted under 35 U.S.C. 154(b) by 112 days.

(21) Appl. No.: 16/126,351

(22) Filed: Sep. 10, 2018

(65) Prior Publication Data

US 2019/0088413 A1 Mar. 21, 2019

(30) Foreign Application Priority Data

Sep. 15, 2017 (JP) ..... JP2017-178179

(51) Int. Cl.
*H01F 27/24* (2006.01)
*H01F 41/02* (2006.01)
(Continued)

(52) U.S. Cl.
CPC ..... *H01F 41/0233* (2013.01); *H01F 17/0013* (2013.01); *H01F 27/24* (2013.01); *H01F 27/2804* (2013.01); *H01F 27/29* (2013.01); *H01F 27/323* (2013.01); *H01F 41/041* (2013.01); *H01F 41/046* (2013.01); *H01F 41/122* (2013.01); *H01F 2003/106* (2013.01); *H01F 2017/0066* (2013.01); *H01F 2017/048* (2013.01); *H01F 2027/2809* (2013.01)

(58) Field of Classification Search
CPC .. H01F 41/0233; H01F 41/041; H01F 41/122; H01F 41/046; H01F 27/2804; H01F 27/24; H01F 27/323; H01F 27/29; H01F 27/292; H01F 27/255; H01F 2027/2809; H01F 17/0013; H01F 2017/0066; H01F 2017/048; H01F 2003/106; H01F 3/08
USPC ..... 336/200, 192, 323, 223
See application file for complete search history.

(56) References Cited

U.S. PATENT DOCUMENTS 8,505,192 B2 * 8/2013 Chu ..... H01F 27/292 29/602.1
2003/0134612 A1 * 7/2003 Nakayama ..... H01F 17/0013 455/307

(Continued)

FOREIGN PATENT DOCUMENTS

JP 2008-166455 A 7/2008
JP 2013-135208 A 7/2013

(Continued)

*Primary Examiner* — Mang Tin Bik Lian
(74) *Attorney, Agent, or Firm* — Oliff PLC

(57) ABSTRACT

Provided is a coil component that includes a coil part having a planar coil that includes a winding section and an insulating section covering the winding section, and a magnetic resin layer including a magnetic filler and configured to cover the coil part. The magnetic resin layer has a first magnetic resin layer that is in contact with the coil part and a second magnetic resin layer that is laminated on the first magnetic resin layer. The second magnetic resin layer constitutes a principal surface of the magnetic resin layer, and a maximum particle size of the magnetic filler contained in the second magnetic resin layer is larger than that of the magnetic filler contained in the first magnetic resin layer.

19 Claims, 11 Drawing Sheets

(51) Int. Cl.

| | |
|---|---|
| ***H01F 27/28*** | (2006.01) |
| ***H01F 41/04*** | (2006.01) |
| ***H01F 41/12*** | (2006.01) |
| ***H01F 27/32*** | (2006.01) |
| ***H01F 27/29*** | (2006.01) |
| ***H01F 17/00*** | (2006.01) |
| *H01F 3/10* | (2006.01) |
| *H01F 17/04* | (2006.01) |

(56) References Cited

U.S. PATENT DOCUMENTS

2006/0158301 A1* 7/2006 Shinkai ..... H01F 17/0013 336/232
2009/0003191 A1* 1/2009 Inuzuka ..... H01F 17/0013 369/283
2012/0131792 A1* 5/2012 Tseng ..... H01F 27/2804 29/602.1
2013/0113593 A1* 5/2013 Jeong ..... H01F 27/292 336/200
2013/0154770 A1* 6/2013 Lee ..... H03H 1/0007 29/842
2013/0162371 A1* 6/2013 Lee ..... H01F 17/0013 427/126.6
2014/0001397 A1* 1/2014 Park ..... H01F 41/14 252/62.54
2014/0002231 A1* 1/2014 Lee ..... H01F 27/255 336/233
2014/0152402 A1* 6/2014 Lee ..... H01F 17/0013 333/185
2014/0176286 A1* 6/2014 Okada ..... C04B 35/265 336/200
2014/0184374 A1* 7/2014 Park ..... H01F 17/0013 336/83
2014/0285303 A1* 9/2014 Cho ..... H01F 27/292 29/602.1
2015/0371752 A1 12/2015 Park et al.
2016/0049234 A1* 2/2016 Kawashima ..... H01F 27/2804 336/200
2016/0126004 A1* 5/2016 Yang ..... H01F 27/292 336/90
2017/0125153 A1 5/2017 Yoshioka et al.
2017/0162319 A1* 6/2017 Otani ..... H01G 4/252
2017/0256353 A1* 9/2017 Park ..... H01F 17/04

FOREIGN PATENT DOCUMENTS

JP 2016-009858 A 1/2016
JP 2016-092404 A 5/2016
JP 2017-092121 A 5/2017

* cited by examiner

COIL COMPONENT AND METHOD OF MANUFACTURING THE SAME

TECHNICAL FIELD

The present invention relates to a coil component and method of manufacturing the same.

BACKGROUND

A coil component is disclosed in Japanese Unexamined Patent Publication No. 2017-092121. This coil component includes a coil substrate that has a two-layered coil conductor and an insulating resin element covering the two-layered coil conductor, and a magnetic resin element that covers a part of the coil substrate. The magnetic resin element is a resin material that contains a magnetic substance.

Meanwhile, in a process of manufacturing the coil component, a process of polishing a magnetic resin layer is performed to secure flatness of the magnetic resin layer. In this case, a situation where a magnetic filler included in the magnetic resin layer falls off from the magnetic resin layer may occur. In this way, when the magnetic filler falls off from the magnetic resin layer, a volume of the magnetic resin layer is reduced, and thus a portion through which magnetic flux can pass is reduced in size. Therefore, permeability of the coil component is reduced. As a result, there is a possibility of inductance being reduced.

The present invention was made in view of the above circumstances, and an object thereof is to provide a coil component capable of inhibiting a reduction in inductance, and a method of manufacturing the same.

SUMMARY

A coil component according to an embodiment of the present invention includes: a coil component that includes a coil part that has a planar coil that includes a winding section and an insulating section covering the winding section; and a magnetic resin layer that includes a magnetic filler and covers the coil part. The magnetic resin layer has a first magnetic resin layer that is in contact with the coil part and a second magnetic resin layer that is laminated on the first magnetic resin layer. The second magnetic resin layer constitutes a principal surface of the magnetic resin layer, and a maximum particle size of the magnetic filler contained in the second magnetic resin layer is smaller than that of the magnetic filler contained in the first magnetic resin layer.

The magnetic resin layer of the coil component has the first magnetic resin layer that is in contact with the coil part, and the second magnetic resin layer that is laminated on the first magnetic resin layer. The maximum particle size of the magnetic filler contained in the second magnetic resin layer is smaller than that of the magnetic filler contained in the first magnetic resin layer. In this way, the second magnetic resin layer containing a relatively fine magnetic filler is laminated on the first magnetic resin layer, and the second magnetic resin layer constitutes the principal surface of the magnetic resin layer. Thus, the second magnetic resin layer is polished in a process of manufacturing the coil component. Since the maximum particle size of the magnetic filler contained in the second magnetic resin layer is relatively small, even if the magnetic filler falls off from the second magnetic resin layer, an amount of reduction in volume of the magnetic resin layer due to the falling off of the magnetic filler is small. Therefore, a reduction in permeability of the coil component is inhibited. As a result, a reduction in inductance can be inhibited.

In the embodiment, the maximum particle size of the magnetic filler contained in the second magnetic resin layer may be not more than 10% of a distance between a principal surface of the coil part which is close to the second magnetic resin layer in a laminating direction and a principal surface of the second magnetic resin layer which is located at a side opposite to the coil part. Due to the maximum particle size of the magnetic filler contained in the second magnetic resin layer being set in this way, a ratio of the size of the magnetic filler to the size of the portion through which the magnetic flux passes is thereby reduced. Therefore, an influence on the permeability according to the falling off of the magnetic filler is reduced, and reduction in the inductance of the coil component is inhibited.

In the embodiment, a thickness of the second magnetic resin layer may be smaller than a distance between a principal surface of the coil part which is close to the second magnetic resin layer in a laminating direction and a principal surface of the second magnetic resin layer which is located at a side opposite to the coil part. According to this constitution, a proportion of the magnetic resin layer occupied by first magnetic resin layer can be increased. Since the maximum particle size of the magnetic filler contained in the first magnetic resin layer is larger than that of the magnetic filler contained in the second magnetic resin layer, permeability of the first magnetic resin layer is higher than that of the second magnetic resin layer. Therefore, the permeability of the coil component can be increased.

In the embodiment, a thickness of the second magnetic resin layer may be larger than or equal to a distance between a principal surface of the coil part which is close to the second magnetic resin layer in a laminating direction and a principal surface of the second magnetic resin layer which is located at a side opposite to the coil part. According to this constitution, the second magnetic resin layer is in contact with the coil part. Since the maximum particle size of the magnetic filler contained in the second magnetic resin layer is smaller than that of the magnetic filler contained in the first magnetic resin layer, adhesion between the second magnetic resin layer and the coil part is higher than that between the first magnetic resin layer and the coil part. Therefore, the second magnetic resin layer and the coil part are in contact with each other, and thereby the adhesion between the magnetic resin layer and the coil part can be increased.

In the embodiment, the magnetic resin layer may have a third magnetic resin layer that is laminated on a side opposite to the second magnetic resin layer with respect to the first magnetic resin layer, and a maximum particle size of a magnetic filler contained in the third magnetic resin layer may be smaller than that of the magnetic filler contained in the first magnetic resin layer. According to this constitution, the second magnetic resin layer is provided close to the principal surface of the coil part, and the third magnetic resin layer containing a relatively fine magnetic filler is formed at a side opposite to the principal surface of the coil part. Thus, symmetry of the coil component in the laminating direction is improved. Therefore, warping of the coil component caused by stress or the like can be inhibited.

A method of manufacturing a coil component according to an embodiment of the present invention includes: a process of forming a coil part having a planar coil that includes a winding section and an insulating section covering the winding section; a process of forming a first magnetic resin layer that is in contact with the coil part on a circumference of the coil part and includes a magnetic filler; a process of laminating a second magnetic resin layer, in which a magnetic filler having a smaller maximum particle size than the magnetic filler contained in the first magnetic resin layer is contained, on the first magnetic resin layer, and forming a magnetic resin layer that covers the coil part with the first magnetic resin layer and the second magnetic resin layer; and a process of polishing the second magnetic resin layer to form a principal surface of the magnetic resin layer.

In the method of manufacturing a coil component, the second magnetic resin layer is polished, and the principal surface of the magnetic resin layer is formed. Since the maximum particle size of the magnetic filler contained in the second magnetic resin layer is relatively small, even if the magnetic filler falls off from the second magnetic resin layer due to the polishing, an amount of reduction in volume of the magnetic resin layer due to the falling off of the magnetic filler is small. Therefore, a reduction in permeability of the coil component is inhibited. As a result, a reduction in inductance can be inhibited.

According to the present invention, a coil component in which a reduction in inductance can be inhibited and a method of manufacturing the same are provided.

DETAILED DESCRIPTION

Hereinafter, various embodiments will be described with reference to the drawings. In each of the drawings, identical or equivalent parts are given the same reference signs, and duplicate description thereof will be omitted.

Figure 1:
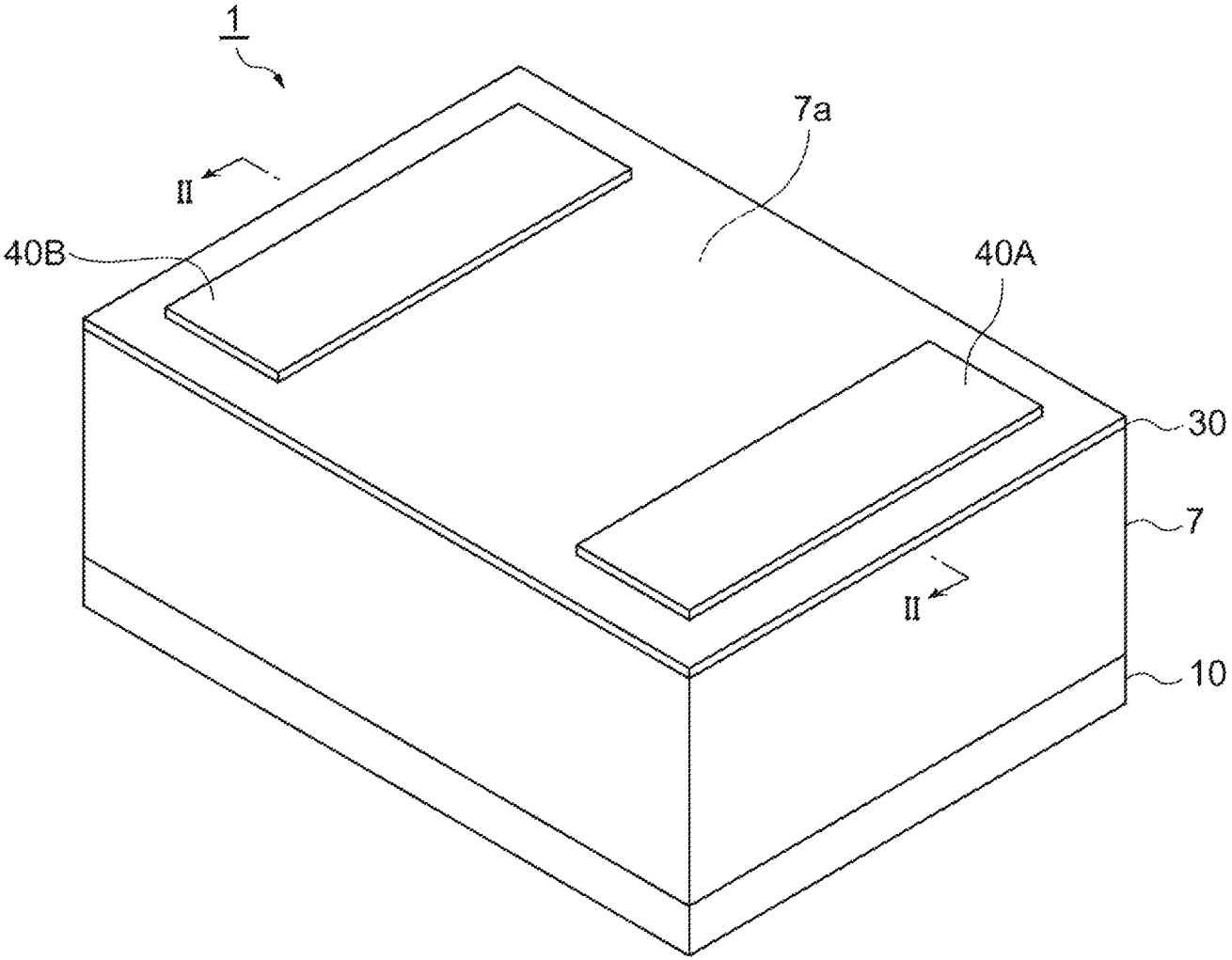
FIG. 1 is a perspective view illustrating a coil component according to an embodiment of the present invention.
Figure 2A:
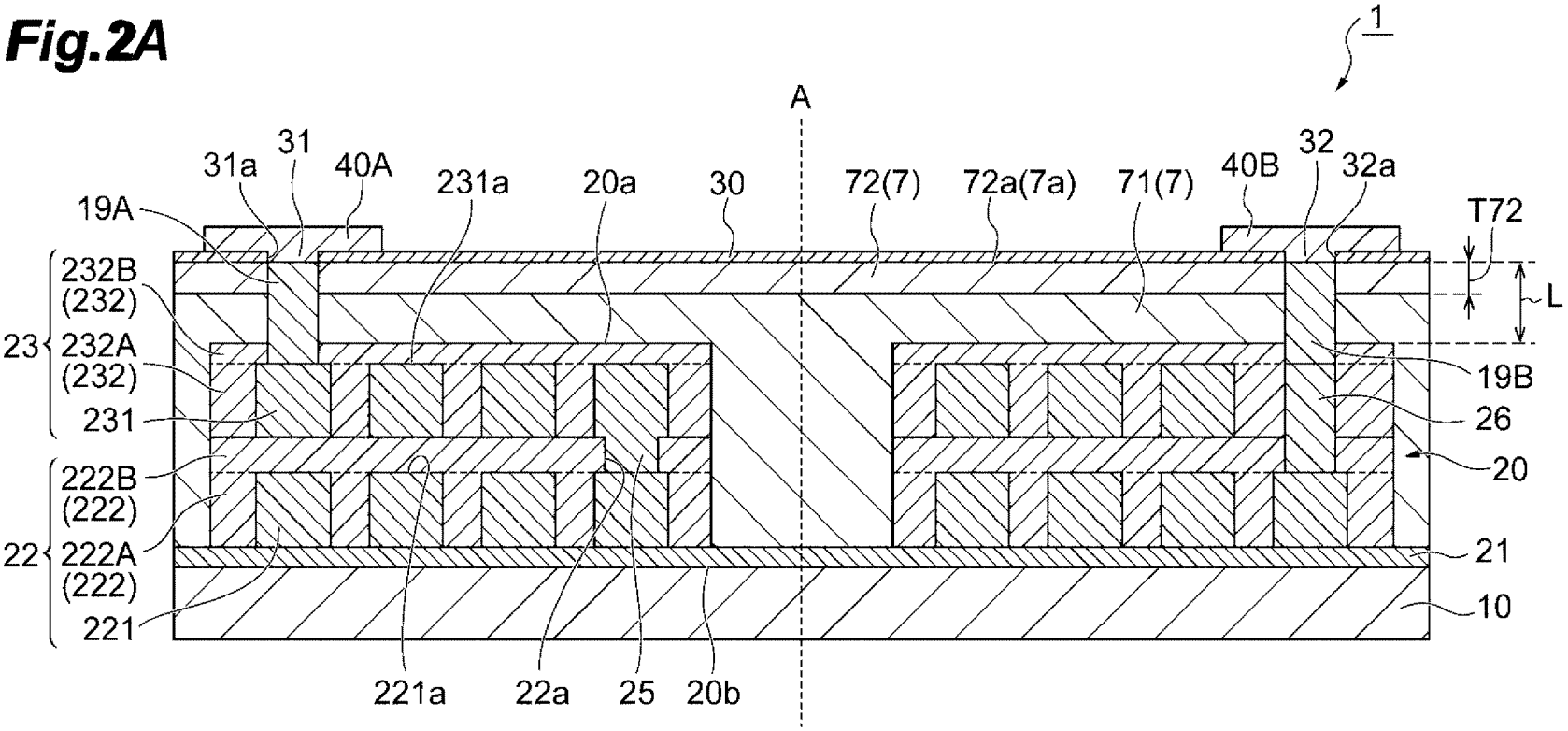
FIG. 2A is a sectional view taken along line II-II of FIG. 1.
Figure 2B:
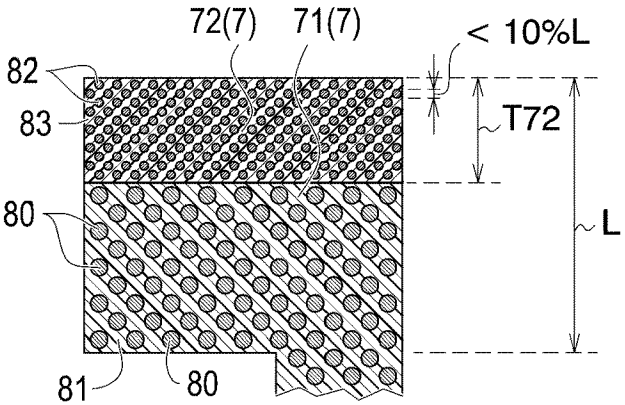
FIG. 2B is a sectional view of a portion of the magnetic resin layer of the coil component of FIG. 1.
Figure 3:
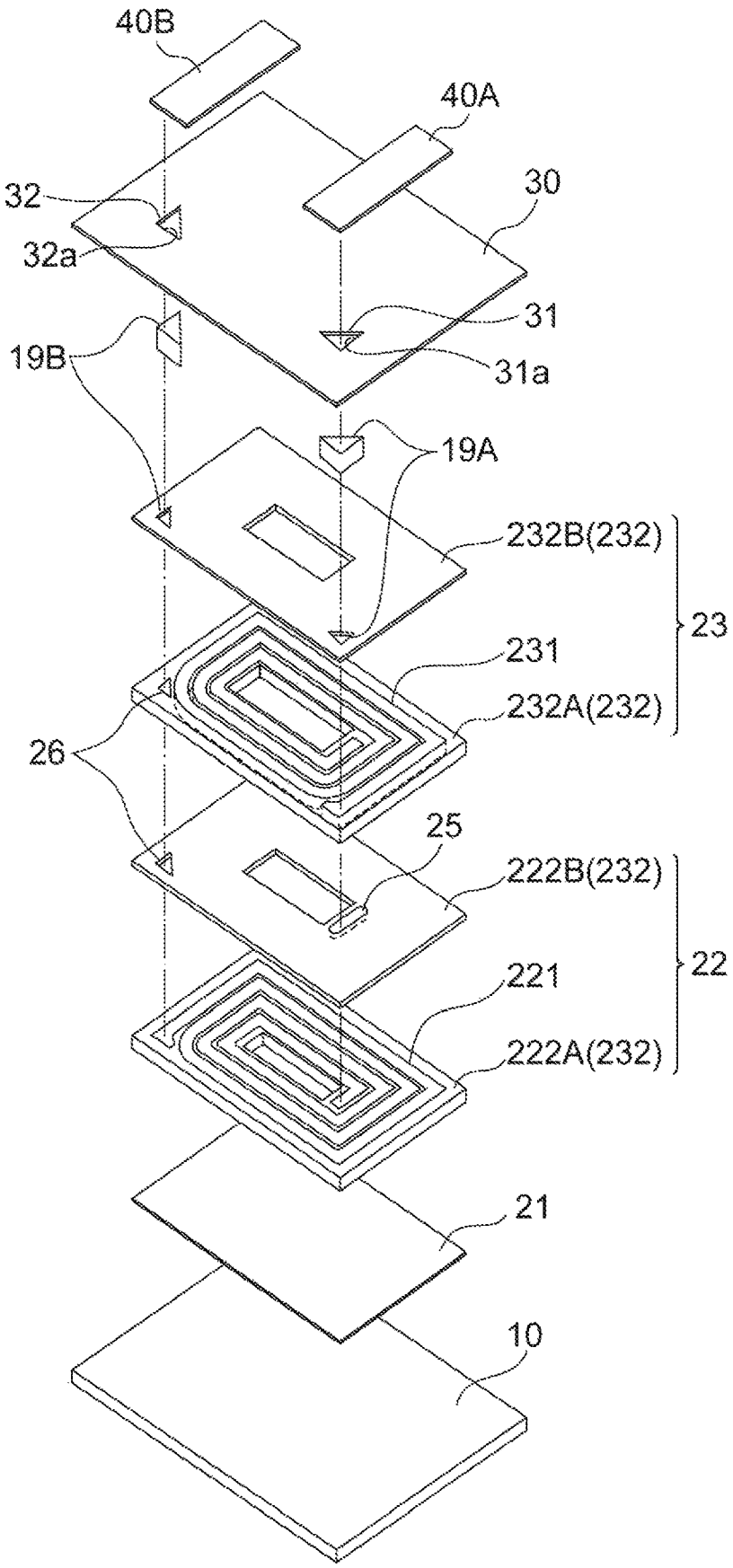
FIG. 3 is an exploded perspective view of a part of the coil component of FIG. 1.

A constitution of a coil component 1 will be described with reference to FIGS. 1 to 3. FIG. 1 is a perspective view illustrating a coil component according to an embodiment of the present invention. FIG. 2A is a sectional view taken along line II-II of FIG. 1. FIG. 2B is an enlargement of a portion of FIG. 2A. FIG. 3 is an exploded perspective view of a part of the coil component 1 of FIG. 1. In FIG. 3, illustration of a magnetic resin layer 7 (to be described below) is omitted.

The coil component 1 illustrated in FIG. 1 is a component mounted on, for instance, a switching power circuit unit that performs voltage conversion of a direct current circuit. As illustrated in FIGS. 1 to 3, the coil component 1 includes a magnetic substrate 10, a coil part 20, a magnetic resin layer 7, conductor posts 19A and 19B, a cover insulating layer 30, and external terminals 40A and 40B.

The term "laminating direction" used herein is a direction in which, like the magnetic substrate 10, the coil part 20, the magnetic resin layer 7, the cover insulating layer 30, and the external terminals 40A and 40B, the layers are overlapped in turn from the magnetic substrate 10 toward the external terminals 40A and 40B. In the following description, the side close to the external terminals 40A and 40B in the laminating direction may be defined as "an upper side," and the side close to the magnetic substrate 10 in the laminating direction may be defined as "a lower side."

The magnetic substrate 10 is a flat plate-shaped substrate formed of, for instance, a magnetic material such as ferrite. The coil part 20 is laminated on the magnetic substrate 10. The coil part 20 is covered with the magnetic resin layer 7. The magnetic resin layer 7 is a mixture that contains a magnetic filler and a binder resin (a resin). The magnetic resin layer 7 has a principal surface 7*a*. The cover insulating layer 30 is laminated on the principal surface 7*a*. The external terminals 40A and 40B are provided on the cover insulating layer 30.

The coil part 20 includes a lower insulating layer 21, a first planar coil 22 that is laminated on the lower insulating layer 21, a second planar coil 23 that is laminated on the first planar coil 22, a via conductor 25 that electrically connects the first planar coil 22 and the second planar coil 23, and a connector 26 that electrically connects the first planar coil 22 and the conductor post 19B. The coil part 20 has a principal surface 20*a* close to the magnetic resin layer 7, and a principal surface 20*b* at a side opposite to the principal surface 20*a* (a side close to the magnetic substrate 10).

The lower insulating layer 21 is laminated on the magnetic substrate 10. The lower insulating layer 21 is provided on an entire surface of the magnetic substrate 10. A principal surface of a lower side of the lower insulating layer 21 (a side close to the magnetic substrate 10) is equivalent to a principal surface 20*b* of the coil part 20.

The first planar coil 22 is perpendicular to the magnetic substrate 10, has an axis A parallel to the laminating direction, and has a rectangular annular shape. The first planar coil 22 includes a first winding section (a winding section) 221 that is wound around the axis A in a rectangular shape, and a first insulating section 222 that covers the first winding section 221. Here, the constitution in which the first insulating section 222 "covers the first winding section 221" refers to a state in which at least a principal surface 221*a* of one side (an upper side, i.e. a side close to the second planar coil 23) of the first winding section 221 and lateral surfaces of the first winding section 221 which are continuous with the principal surface 221*a* are in contact with the first insulating section 222. The first winding section 221 is laminated on the lower insulating layer 21, and a principal surface of a lower side of the first winding section 221 (a side close to the magnetic substrate 10) is in contact with the lower insulating layer 21. The first winding section 221 is formed of, for instance, a metal material such as copper (Cu).

The first insulating section 222 includes two insulating layers 222A and 222B. A circumference of the first winding section 221 in the same layer as the first winding section 221 is filled with the insulating layer 222A. The insulating layer 222A fills gaps between turn portions of the first winding section 221. The insulating layer 222B is in contact with the principal surface 221*a* of the one side of the first winding section 221. A through-hole that passes through the first insulating section 222 in the laminating direction is formed in a region of the first insulating section 222 which corresponds to an inner diameter of the coil part 20. A through-hole 22*a* that passes through the first insulating section 222 is provided in the first insulating section 222. The through-hole 22*a* is formed in the insulating layer 222B of the first insulating section 222. In the present embodiment, the insulating layers 222A and 222B are integrally provided. However, the insulating layer 222A and the insulating layer 222B may be provided as different layers. The first insulating section 222 may include the lower insulating layer 21.

Like the first planar coil 22, the second planar coil 23 has a rectangular annular shape. The second planar coil 23 includes a second winding section 231 that is wound around the axis A in a rectangular shape, and a second insulating section 232 that covers the second winding section 231. Here, the constitution in which the second insulating section 232 "covers the second winding section 231" refers to a state in which at least a principal surface 231*a* of one side of the second winding section 231 (an upper side, i.e. a side close to the magnetic resin layer 7) and lateral surfaces of the second winding section 231 which are continuous with the principal surface 231*a* are in contact with the second insulating section 232. The second winding section 231 is laminated on the first insulating section 222, and a principal surface of a lower side of the second winding section 231 (a side close to the first insulating section 222) is in contact with the first insulating section 222 (the insulating layer 222B). The second winding section 231 is formed of, for instance, a metal material such as copper (Cu).

The second insulating section 232 includes two insulating layers 232A and 232B. A circumference of the second winding section 231 in the same layer as the second winding section 231 is filled with the insulating layer 232A. The insulating layer 232A fills gaps between turn portions of the second winding section 231. The insulating layer 232B covers the principal surface 231*a* of the one side of the second winding section 231 (the upper side, i.e. the side close to the magnetic resin layer 7). A through-hole that passes through the second insulating section 232 in the laminating direction is formed in a region of the second insulating section 232 which corresponds to the inner diameter of the coil part 20. A principal surface of an upper side of the second insulating section 232 is equivalent to the principal surface 20*a* of the coil part 20. In the present embodiment, the insulating layers 232A and 232B are integrally provided. However, the insulating layer 232A and the insulating layer 232B may be provided as different layers.

The lower insulating layer 21, the first insulating section 222, and the second insulating section 232 are formed of an insulating resin. Examples of the insulating resin include, for instance, polyimide or polyethylene terephthalate. The lower insulating layer 21, the first insulating section 222, and the second insulating section 232 may be formed of the same material or different materials.

The via conductor 25 is provided in the through-hole 22*a* that passes through the first insulating section 222. The via conductor 25 electrically connects the innermost turn portion of the first winding section 221 and the innermost turn portion of the second winding section 231. Thereby, one coil is formed by the first planar coil 22 and the second planar coil 23. As illustrated in FIG. 2, the via conductor 25 may be formed integrally with the second winding section 231. The connector 26 extends from an outer end of the first winding section 221 through the insulating layer 222B and the insulating layer 232A toward the principal surface 7*a* of the magnetic resin layer 7, and electrically connects the first winding section 221 and the conductor post 19B.

The magnetic resin layer 7 covers a circumference of the coil part 20. The magnetic resin layer 7 has a contour of a cuboidal shape. The cuboidal shape includes a shape of a cuboid whose corners and edges are chamfered, and a shape of a cuboid whose corners and edges are rounded. The principal surface 7*a* of the magnetic resin layer 7 has a rectangular shape with long and short sides. The magnetic resin layer 7 has a first magnetic resin layer 71 and a second magnetic resin layer 72.

The first magnetic resin layer 71 covers the circumference of the coil part 20 while being in contact with the coil part 20. In the present embodiment, the first magnetic resin layer 71 covers lateral surfaces of the coil part 20 and the principal surface 20*a* of the coil part 20, and is in contact with the principal surface 20*a* of the coil part 20. The first magnetic resin layer 71 is filled into a portion that corresponds to the inner diameter of the coil part 20.

The first magnetic resin layer 71 is formed of a mixture that contains a magnetic filler 80 and a binder resin 81 (a resin). A constituent material of the magnetic filler 80 contained in the first magnetic resin layer 71 is, for instance, iron, carbonyl iron, silicon, chromium, nickel, or boron. A constituent material of the binder resin 81 is, for instance, an epoxy resin. A proportion of the magnetic filler 80 contained in the first magnetic resin layer 71 is, for instance, not less than 90 wt % with respect to the entirety of the first magnetic resin layer 71. A proportion of the binder resin 81 contained in the first magnetic resin layer 71 is, for instance, not less than 3 wt % with respect to the entirety of the first magnetic resin layer 71. A maximum particle size of the magnetic filler 80 contained in the first magnetic resin layer 71 is, for instance, not less than 40 μm and not more than 80 μm.

The second magnetic resin layer 72 is laminated on the first magnetic resin layer 71. In the present embodiment, the second magnetic resin layer 72 is provided on the first magnetic resin layer 71 that covers the principal surface 20*a* of the coil part 20. Therefore, the second magnetic resin layer 72 and the coil part 20 are spaced apart from each other. The second magnetic resin layer 72 has a principal surface 72*a* at a side opposite to the coil part 20. The principal surface 72*a* of the second magnetic resin layer 72 is equivalent to the principal surface 7*a* of the magnetic resin layer 7.

Like the first magnetic resin layer 71, the second magnetic resin layer 72 is formed of a mixture that contains a magnetic filler 82 and a binder resin 83 (a resin). A constituent material of the magnetic filler 82 contained in the second magnetic resin layer 72 is, for instance, iron, carbonyl iron, silicon, chromium, nickel, or boron. A constituent material of the binder resin 83 is, for instance, an epoxy resin. A proportion of the magnetic filler 82 contained in the second magnetic resin layer 72 is, for instance, not less than 90 wt % of the entirety of the second magnetic resin layer 72. A proportion of the binder resin 83 contained in the second magnetic resin layer 72 is, for instance, not less than 3 wt % with respect to the entirety of the second magnetic resin layer 72. As shown in FIG. 2B, a maximum particle size of the magnetic filler 82 contained in the second magnetic resin layer 72 is smaller than that of the magnetic filler 80 contained in the first magnetic resin layer 71, and is, for instance, not less than 1 μm and not more than 10 μm. As also shown in FIG. 2B, the maximum particle size of the magnetic filler 82 contained in the second magnetic resin layer 72 can be set to not more than 10% of a distance L between the principal surface 20*a* of the coil part 20 which is close to the second magnetic resin layer 72 (close to the magnetic resin layer 7) in the laminating direction and the principal surface 72*a* of the second magnetic resin layer 72 (the principal surface 7*a* of the magnetic resin layer 7) which is located at a side opposite to the coil part 20. The distance L is equivalent to a thickness of the magnetic resin layer 7 provided above the principal surface 20*a* of the coil part 20. A thickness T72 of the second magnetic resin layer 72 is smaller than the distance L. For example, the distance L is not less than 100 μm or so and not more than 200 μm or so, and the thickness T72 of the second magnetic resin layer 72 is not less than 10 μm or so and not more than 20 μm or so.

The pair of conductor posts 19A and 19B are formed of, for instance, copper (Cu), and extend from opposite ends of the coil part 20, which are opposite to each other in an intersecting direction perpendicular to the laminating direction, in the laminating direction. The conductor post 19A is connected to an outer end of the second winding section 231. The conductor post 19A extends from the second winding section 231 to the principal surface 7*a* of the magnetic resin layer 7 to pass through the magnetic resin layer 7 (the first magnetic resin layer 71 and the second magnetic resin layer 72), and is exposed to the principal surface 7*a*. The external terminal 40A is provided at a position corresponding to the exposed portion of the conductor post 19A. The conductor post 19A is connected to the external terminal 40A by a conductor part 31 in a through-hole 31 a of the cover insulating layer 30. Thereby, the outer end of the second winding section 231 (one end of the coil part 20) and the external terminal 40A are electrically connected via the conductor post 19A and the conductor part 31.

The conductor post 19B is connected to the connector 26. The conductor post 19B extends from the connector 26 to the principal surface 7*a* of the magnetic resin layer 7 to pass through the magnetic resin layer 7, and is exposed to the principal surface 7*a*. The external terminal 40B is provided at a position corresponding to the exposed portion of the conductor post 19B. The conductor post 19B is connected to the external terminal 40B by a conductor part 32 in a through-hole 32*a* of the cover insulating layer 30. Thereby, an outer end of the first winding section 221 (the other end of the coil part 20) and the external terminal 40B are electrically connected via the connector 26, the conductor post 19B, and the conductor part 32.

The external terminal 40A is parallel to one short side of the principal surface 7*a*, and the external terminal 40B is parallel to the other short side of the principal surface 7*a*. The external terminals 40A and 40B are spaced apart from each other in a direction parallel to long sides of the principal surface 7*a*. Each of the pair of external terminals 40A and 40B has a film shape, and a rectangular shape in a top view. The external terminals 40A and 40B are electrically connected to the conductor posts 19A and 19B, respectively. The external terminals 40A and 40B are formed of a conductive material such as copper (Cu). The external terminals 40A and 40B can be formed by, for instance, plating. The external terminals 40A and 40B may have a single layer structure or a laminated structure in which a plurality of layers are laminated.

The cover insulating layer 30 is provided on the principal surface 7*a* of the magnetic resin layer 7 (the first magnetic resin layer 71), and is located between the conductor posts 19A and 19B and the external terminals 40A and 40B in the laminating direction. The cover insulating layer 30 has the through-holes 31*a* and 32*a* at positions corresponding to the conductor posts 19A and 19B. The conductor parts 31 and 32 formed of a conductive material such as copper (Cu) are provided in the through-holes 31*a* and 32*a*. The cover insulating layer 30 is formed of an insulating material, for instance an insulating resin such as polyimide, epoxy, or the like.

Next, a method of manufacturing the coil component 1 will be described with reference to FIGS. 4A to 7B. FIGS. 4A to 7B are view illustrating a method of manufacturing the coil component 1.

Figure 4A:
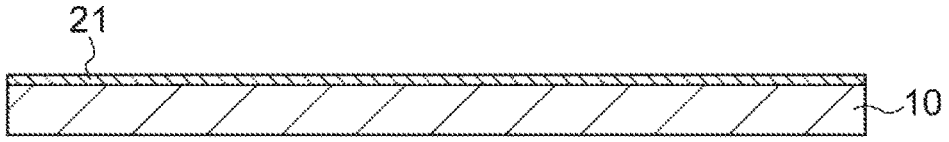
FIG. 4A is a view illustrating a method of manufacturing the coil component of FIG. 1.
Figure 4B:
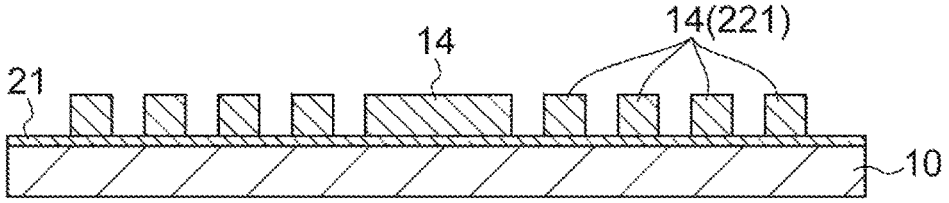
FIG. 4B is a view illustrating a method of manufacturing the coil component of FIG. 1.
Figure 4C:
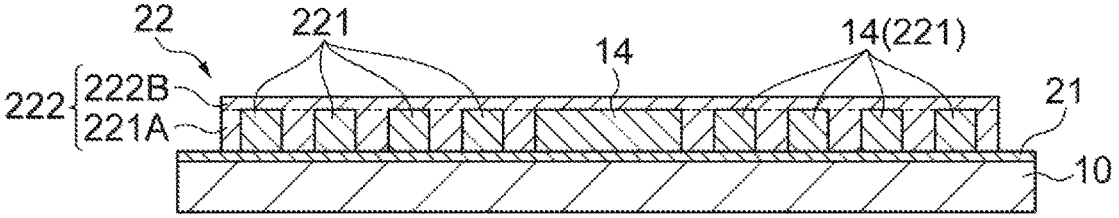
FIG. 4C is a view illustrating a method of manufacturing the coil component of FIG. 1.

First, the coil part 20 is formed on the magnetic substrate 10. To be specific, as illustrated in FIG. 4A, an insulating paste pattern is applied to and cured on the magnetic substrate 10, and thereby is formed into the lower insulating layer 21. Then, as illustrated in FIG. 4B, a metal layer 14 is formed on the lower insulating layer 21. The metal layer 14 can be formed by, for instance, plating or sputtering. Afterward, the first winding section 221 is formed by performing patterning using a predetermined mask. Then, as illustrated in FIG. 4C, the first insulating section 222 is formed. The first insulating section 222 can be formed by applying and curing an insulating paste pattern to and on the metal layer 14. In this case, the insulating layers 222A and 222B of the first insulating section 222 are formed at one time.

Figure 5A:
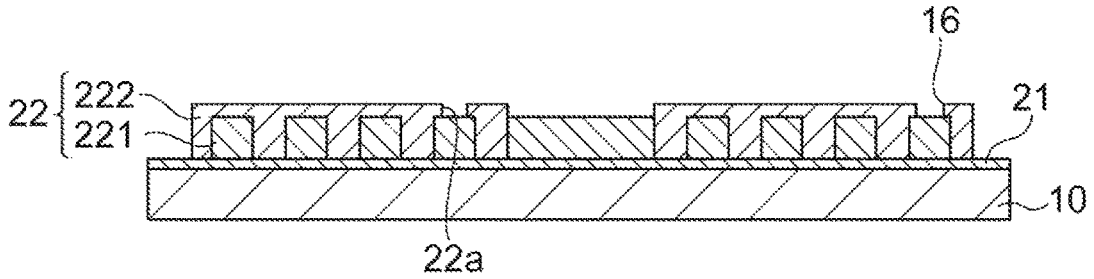
FIG. 5A is a view illustrating a method of manufacturing the coil component of FIG. 1.

Then, as illustrated in FIG. 5A, the first insulating section 222 (the insulating layer 222B) is etched, and thereby the through-hole 22*a* and an opening 16 for forming a part of the connector 26 are formed. Thereby, the first planar coil 22 is formed.

Figure 5B:
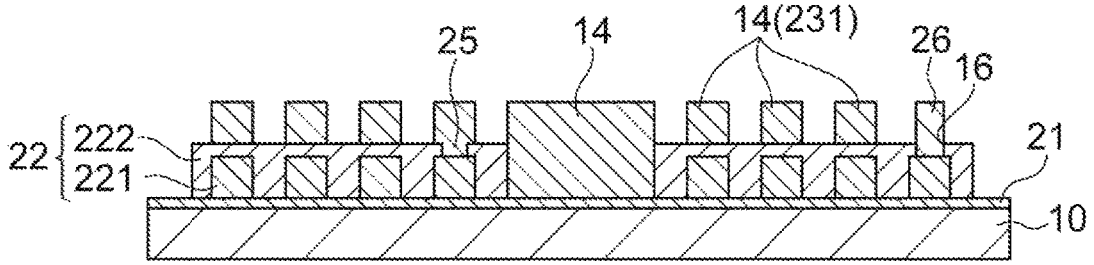
FIG. 5B is a view illustrating a method of manufacturing the coil component of FIG. 1.

Next, as illustrated in FIG. 5B, the metal layer 14 is formed on the second insulating section 232 again by plating or sputtering. Afterward, the second winding section 231 is formed by performing patterning using a predetermined mask. In this case, the via conductor 25 is formed in the through-hole 22*a*. The connector 26 is formed at a position corresponding to the opening 16.

Figure 5C:
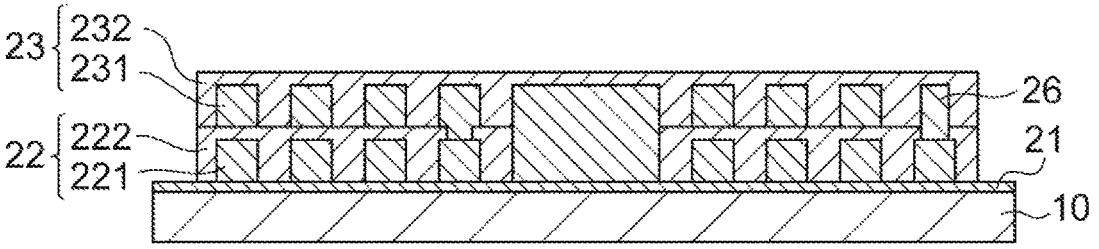
FIG. 5C is a view illustrating a method of manufacturing the coil component of FIG. 1.

Next, as illustrated in FIG. 5C, the second insulating section 232 is formed. The second insulating section 232 can be formed on the metal layer 14 (the second winding section 231) by applying and curing an insulating paste pattern. In this case, the insulating layers 232A and 232B of the second insulating section 232 are formed at one time. Thereby, the second planar coil 23 is formed.

Figure 6A:
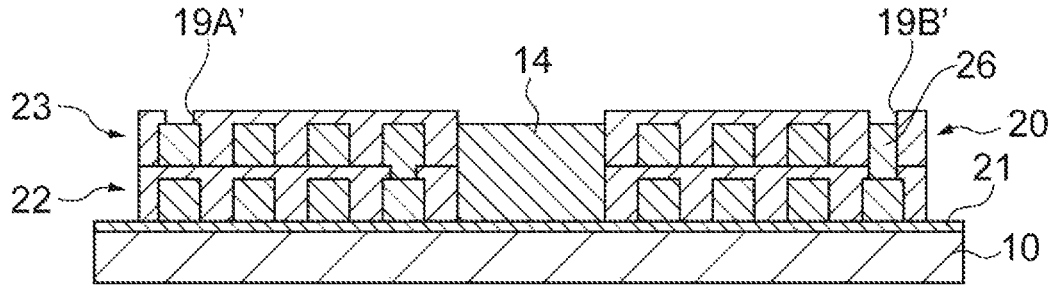
FIG. 6A is a view illustrating a method of manufacturing the coil component of FIG. 1.

Next, as illustrated in FIG. 6A, the second insulating section 232 (the insulating layer 232B) is etched, and openings 19A' and 19B' for forming the conductor posts 19A and 19B are formed. According to the aforementioned processes, the coil part 20 is formed.

Figure 6B:
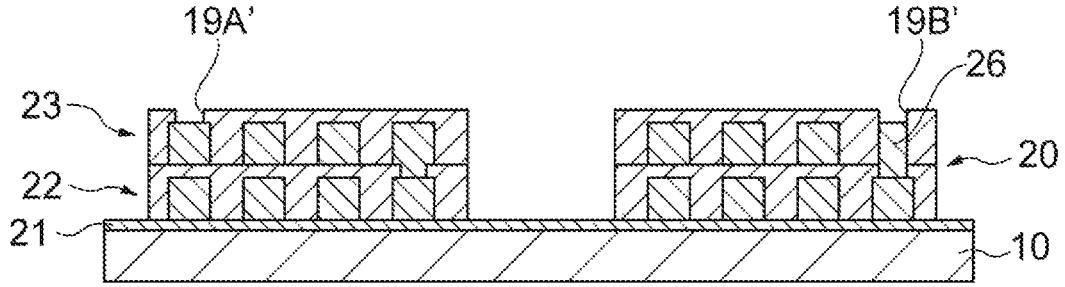
FIG. 6B is a view illustrating a method of manufacturing the coil component of FIG. 1.

Next, as illustrated in FIG. 6B, portions where the first winding section 221 and the second winding section 231 are not formed (portions corresponding to inner diameter portions and outer circumferential portions of the first planar coil 22 and the second planar coil 23) are etched, and the metal layer 14 is removed.

Figure 6C:
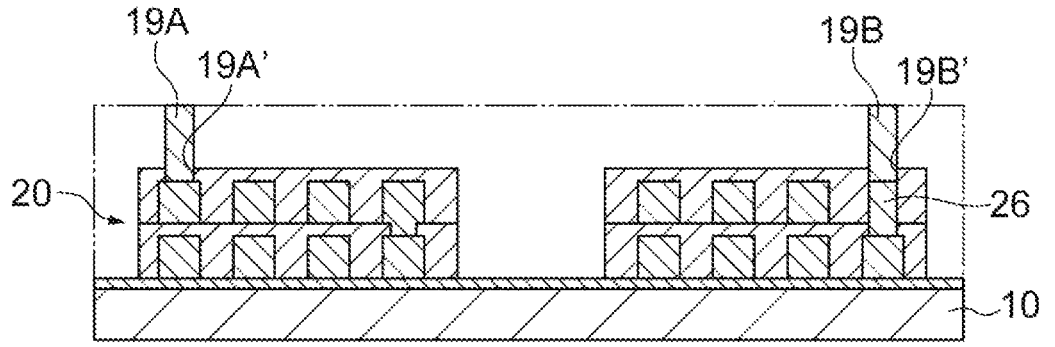
FIG. 6C is a view illustrating a method of manufacturing the coil component of FIG. 1.

Next, as illustrated in FIG. 6C, the conductor posts 19A and 19B are formed. To be specific, seed parts are formed on the openings 19A' and 19B' of the second insulating section 232 by plating or sputtering using a predetermined mask, and the conductor posts 19A and 19B are formed by plating using the seed parts. When the conductor posts 19A and 19B are formed by plating, for instance an insulating sacrificial layer (a portion denoted by a dashed double-dotted line) can be used.

Figure 7A:
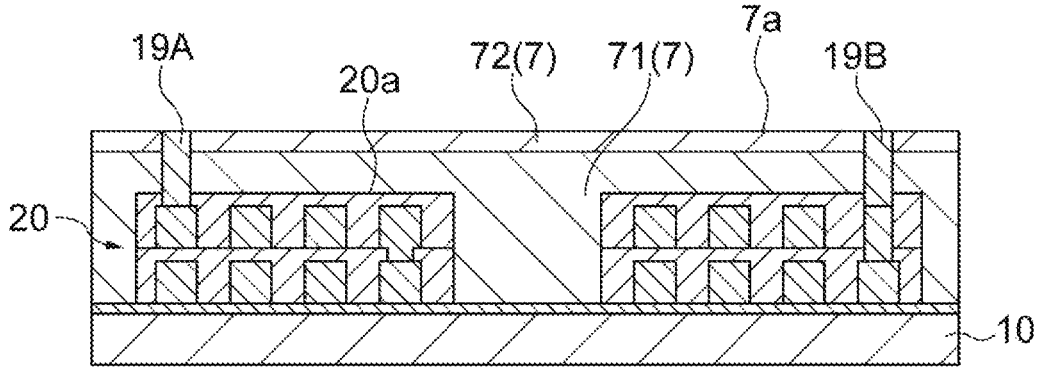
FIG. 7A is a view illustrating a method of manufacturing the coil component of FIG. 1.

Next, as illustrated in FIG. 7A, a magnetic resin containing a magnetic filler and a resin is applied to an entire surface of the magnetic substrate 10, and is cured, and thereby the first magnetic resin layer 71 is formed. Thereby, the principal surface 20*a* of the coil part 20 and parts of the circumferences of the conductor posts 19A and 19B are covered by the first magnetic resin layer 71. In this case, an inner diameter portion of the coil part 20 is also filled with the first magnetic resin layer 71. Afterward, a magnetic resin containing a magnetic filler 82 having a smaller maximum particle size than the magnetic filler 80 contained in the first magnetic resin layer 71 is applied to the first magnetic resin layer 71, and the second magnetic resin layer 72 is formed. Thereby, the circumferences of the conductor posts 19A and 19B are covered by the first magnetic resin layer 71 and the second magnetic resin layer 72.

Next, a surface of the second magnetic resin layer 72 is polished, and thereby the principal surface 7*a* of the magnetic resin layer 7 is formed. The second magnetic resin layer 72 can be polished by a well-known method such as grinding. For example, a wheel of about #400 is rotated at 300 to 6000 rpm, and the second magnetic resin layer 72 is polished. This polishing is performed, and thereby the flat principal surface 7*a* is obtained.

Figure 7B:
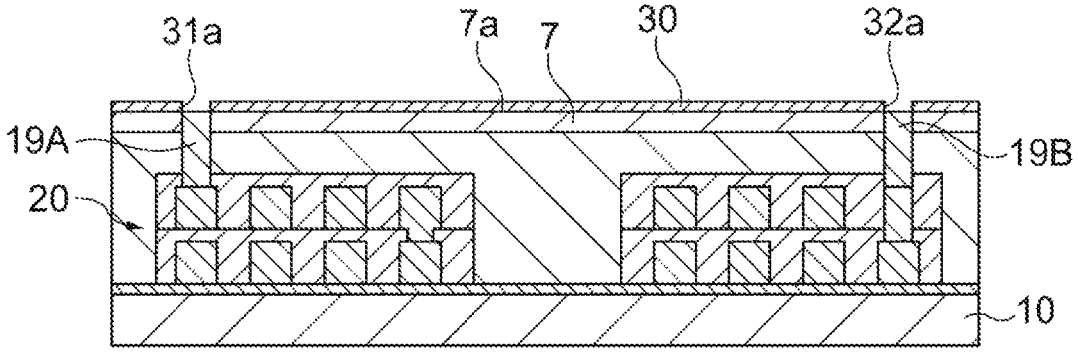
FIG. 7B is a view illustrating a method of manufacturing the coil component of FIG. 1.

Next, as illustrated in FIG. 7B, an insulating material such as an insulating resin paste is applied to the principal surface 7*a* of the magnetic resin layer 7, and thereby the cover insulating layer 30 is formed. When the cover insulating layer 30 is formed, the entire principal surface 7*a* is covered, and simultaneously the through-holes 31*a* and 32*a* are formed at positions corresponding to the pair of conductor posts 19A and 19B, so that the pair of conductor posts 19A and 19B are exposed from the cover insulating layer 30. To be specific, an insulating material is applied to the entire principal surface 7*a*, and then the cover insulating layer 30 is removed from places corresponding to the conductor posts 19A and 19B.

Next, seed parts are formed on regions corresponding to the external terminals 40A and 40B on the cover insulating layer 30 by plating or sputtering using a predetermined mask. The seed parts are formed on the conductor posts 19A and 19B exposed from the through-holes 31*a* and 32*a* of the cover insulating layer 30. Next, the external terminals 40A and 40B are formed by nonelectrolytic plating using the seed parts. In this case, the plating seed parts grow to fill the through-holes 31*a* and 32*a* of the cover insulating layer 30, and the conductor parts 31 and 32 are formed. According to the aforementioned processes, the coil component 1 illustrated in FIG. 2 is formed.

As described above, the magnetic resin layer 7 of the coil component 1 has the first magnetic resin layer 71 that is in contact with the coil part 20, and the second magnetic resin layer 72 that is laminated on the first magnetic resin layer 71. The maximum particle size of the magnetic filler 82 contained in the second magnetic resin layer 72 is smaller than that of the magnetic filler 80 contained in the first magnetic resin layer 71. In this way, the second magnetic resin layer 72 containing a relatively fine magnetic filler is laminated on the first magnetic resin layer 71, and the second magnetic resin layer 72 constitutes the principal surface 7*a* of the magnetic resin layer 7. Thus, the second magnetic resin layer 72 is polished in a process of manufacturing the coil component 1. Since the maximum particle size of the magnetic filler contained in the second magnetic resin layer is relatively small, even if magnetic filler falls off from the second magnetic resin layer 72 at the time of polishing, an amount of reduction in volume of the magnetic resin layer due to the falling off of the magnetic filler is small. Therefore, a reduction in permeability of the coil component 1 is inhibited. As a result, a reduction in inductance can be inhibited.

Figure 8:
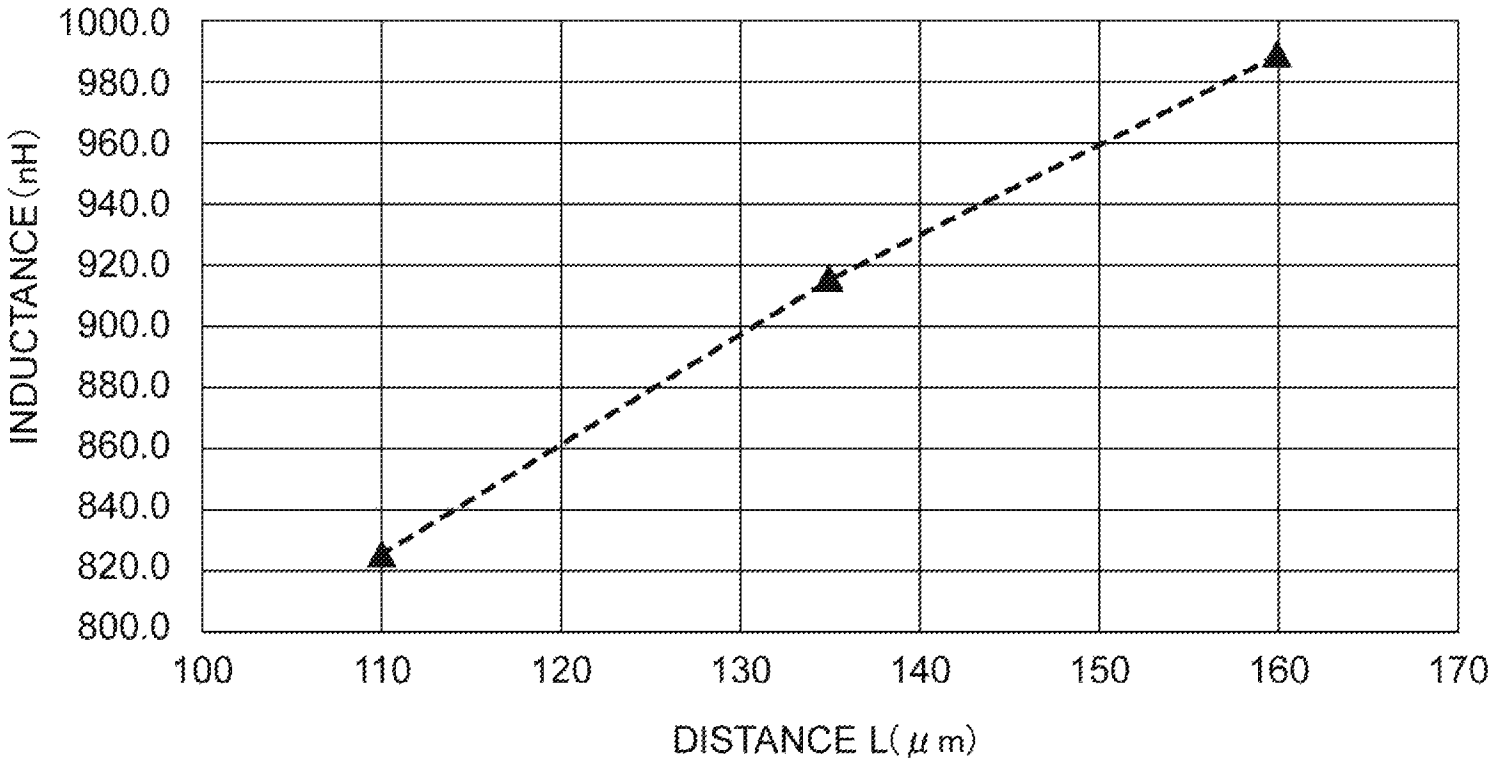
FIG. 8 is a view illustrating effects of the coil component 1 of FIG. 1.

FIG. 8 is a view illustrating effects of the coil component 1 of FIG. 1. FIG. 8 illustrates results of simulating a relationship between inductance and a distance L between the principal surface 20*a* of the coil part 20 which is close to the second magnetic resin layer 72 (close to the magnetic resin layer 7) in the laminating direction and the principal surface 72*a* of the second magnetic resin layer 72 (the principal surface 7*a* of the magnetic resin layer 7) which is located at a side (an upper side) opposite to the coil part 20. In the simulation, a Maxwell equation of electromagnetism is solved by numerical simulation using a three-dimensional electromagnetic field simulator (a finite element method). FIG. 8 illustrates values of inductance at 1 MHz. In the simulation, when a value of the distance L is changed to 160 μm, 135 μm (down of about 15%), and 110 μm (down of about 30%), each value of inductance of the coil component 1 is checked. That is, in the simulation, the value of the distance L is reduced to 135 μm and 110 μm on the basis of the case in which the value of the distance L is 160 μm. Thereby, a state in which the volume of the magnetic resin layer 7 is reduced by falling off of the magnetic filler is simulatively represented.

As illustrated in FIG. 8, as the distance L is reduced, the values of the inductance of the coil component 1 are reduced. That is, as the volume of the magnetic resin layer 7 is reduced, the inductance of the coil component 1 is reduced. In this way, it can be ascertained from the simulated results illustrated in FIG. 8 that, even if the magnetic filler 82 that is contained in the second magnetic resin layer 72 and is relatively small in the maximum particle size thereof falls off, the amount of reduction in the volume of the magnetic resin layer 7 is small, and thus the reduction in the inductance of the coil component 1 is inhibited.

The maximum particle size of the magnetic filler 82 contained in the second magnetic resin layer 72 is not more than 10% of the distance L between the principal surface 20*a* of the coil part 20 which is close to the second magnetic resin layer 72 in the laminating direction and the principal surface 7*a* of the second magnetic resin layer 72 which is located at the side opposite to the coil part 20. The maximum particle size of the magnetic filler 82 contained in the second magnetic resin layer 172 is set in this way, and thereby a ratio of the size of the magnetic filler to the size of the portion through which the magnetic flux passes is reduced. Therefore, an influence on the permeability according to the falling off of the magnetic filler is reduced, and the reduction in the inductance of the coil component 1 is inhibited.

The thickness T72 of the second magnetic resin layer 72 is smaller than the distance L between the principal surface 20a of the coil part 20 which is close to the second magnetic resin layer 72 in the laminating direction and the principal surface 7*a* of the second magnetic resin layer 72 which is located at the side opposite to the coil part 20. Thereby, a ratio of the first magnetic resin layer 71 to the magnetic resin layer 7 can be increased. Since the maximum particle size of the magnetic filler 80 contained in the first magnetic resin layer 71 is larger than that of the magnetic filler 82 contained in the second magnetic resin layer 72, the permeability of the first magnetic resin layer 71 is larger than that of the second magnetic resin layer 72. Therefore, the ratio of the first magnetic resin layer 71 to the magnetic resin layer 7 is increased, and thereby the permeability of the entire magnetic resin layer 7 can be increased. Therefore, the permeability of the coil component 1 can be increased.

In the method of manufacturing the coil component 1 according to the present embodiment, the principal surface 7*a* of the magnetic resin layer 7 is formed by polishing the second magnetic resin layer 72. Since the maximum particle size of the magnetic filler 82 contained in the second magnetic resin layer 72 is relatively small, even if the magnetic filler 82 falls off from the second magnetic resin layer 72 due to the polishing, the amount of reduction in the volume of the magnetic resin layer 7 due to the falling off of the magnetic filler is small. Therefore, the reduction in the permeability of the coil component 1 is inhibited. As a result, the reduction in the inductance can be inhibited.

The principal surface 7*a* of the magnetic resin layer 7 is formed by polishing the second magnetic resin layer 72, and thereby flatness of the surface of the coil component 1 can be improved. Thereby, when the coil component 1 is mounted on a substrate or the like, installation of the coil component 1 can be facilitated. For example, when an underfill material is filled between the coil component 1 and the substrate on which the coil component 1 is mounted, the filling of the underfill material can be facilitated because the surface of the coil component 1 is flat.

Figure 9:
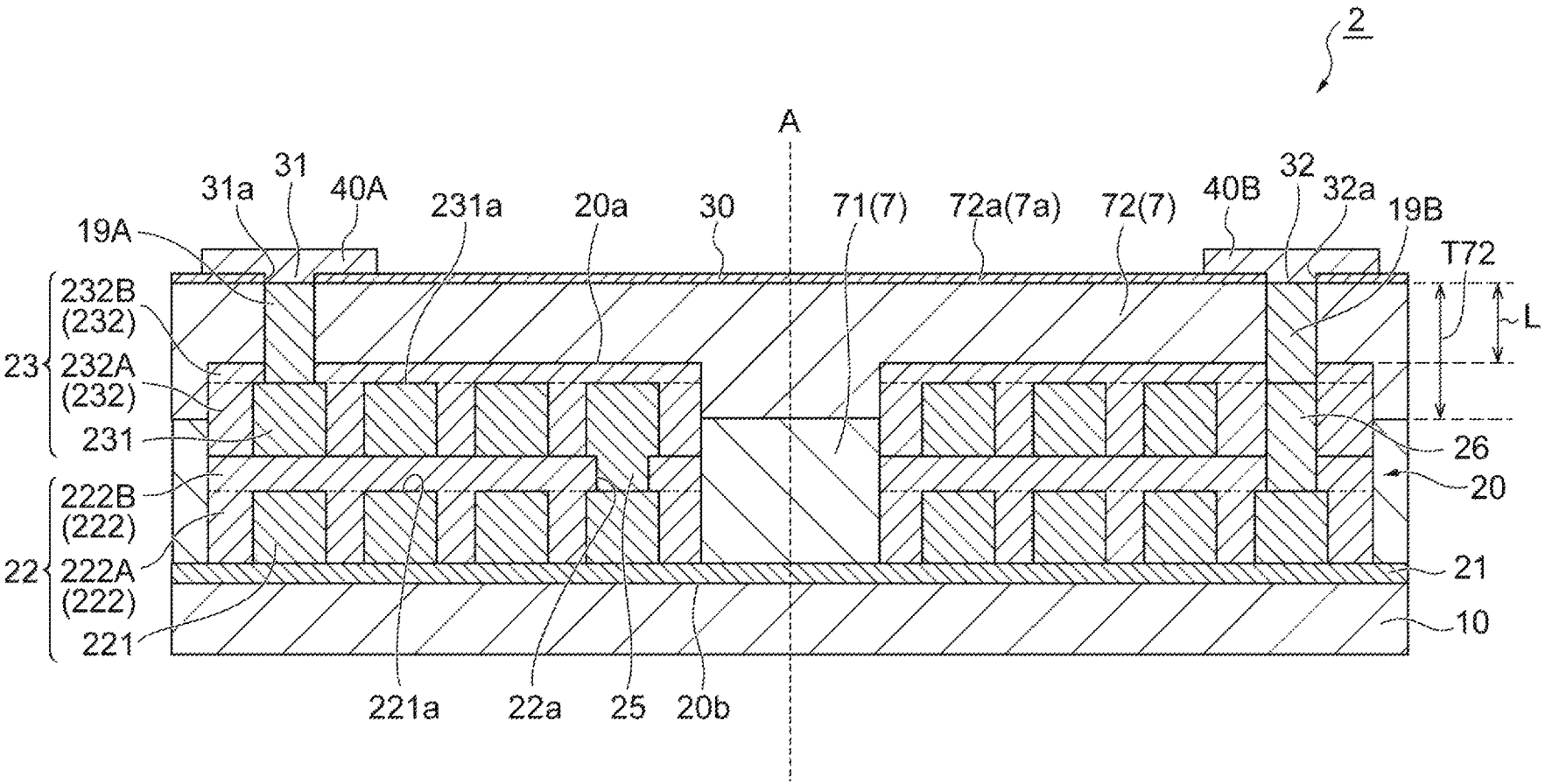
FIG. 9 is a sectional view schematically illustrating a coil component according to a modification.

Next, a coil component 2 according to a modification will be described with reference to FIG. 9. FIG. 9 is a sectional view schematically illustrating a coil component according to a modification. As illustrated in FIG. 9, like the coil component 1, the coil component 2 includes a magnetic substrate 10, a coil part 20, a first magnetic resin layer 71, a second magnetic resin layer 72, conductor posts 19A and 19B, a cover insulating layer 30, and external terminals 40A and 40B. The coil component 2 is different from the coil component 1 in that a thickness of the second magnetic resin layer 72 is not more than a distance L between a principal surface 20*a* of the coil part 20 which is close to the second magnetic resin layer 72 in a laminating direction and a principal surface 7*a* of the second magnetic resin layer 72 which is located at a side opposite to the coil part 20. The second magnetic resin layer 72 is in contact with the principal surface 20*a* of the coil part 20. The first magnetic resin layer 71 is filled in portions that correspond to a circumference and an inner diameter of the coil part 20 at a side below the principal surface 20*a* of the coil part 20 (a side close to the magnetic substrate 10).

Like the coil component 1, in the coil component 2, since the second magnetic resin layer 72 containing a relatively fine magnetic filler is laminated on the first magnetic resin layer 71, the second magnetic resin layer 72 is polished in a process of manufacturing the coil component 2. Since a maximum particle size of the magnetic filler contained in the second magnetic resin layer is relatively small, even if the magnetic filler falls off from the second magnetic resin layer 72, an amount of reduction in volume of the magnetic resin layer due to the falling off of the magnetic filler is small. Therefore, a reduction in permeability of the coil component 2 is inhibited. As a result, a reduction in inductance can be inhibited.

The thickness T72 of the second magnetic resin layer 72 is not less than the distance L between the principal surface 20*a* of the coil part 20 which is close to the second magnetic resin layer 72 in the laminating direction and the principal surface 7*a* of the second magnetic resin layer 72 which is located at the side opposite to the coil part 20. Thereby, the second magnetic resin layer 72 is in contact with the coil part 20. Since the maximum particle size of the magnetic filler contained in the second magnetic resin layer 72 is smaller than that of the magnetic filler contained in the first magnetic resin layer 71, adhesion between the second magnetic resin layer 72 and the coil part 20 is higher than that between the first magnetic resin layer 71 and the coil part 20. Therefore, the second magnetic resin layer 72 and the coil part 20 are in contact with each other, and thereby the adhesion between the magnetic resin layer 7 and the coil part 20 can be increased.

Figure 10:
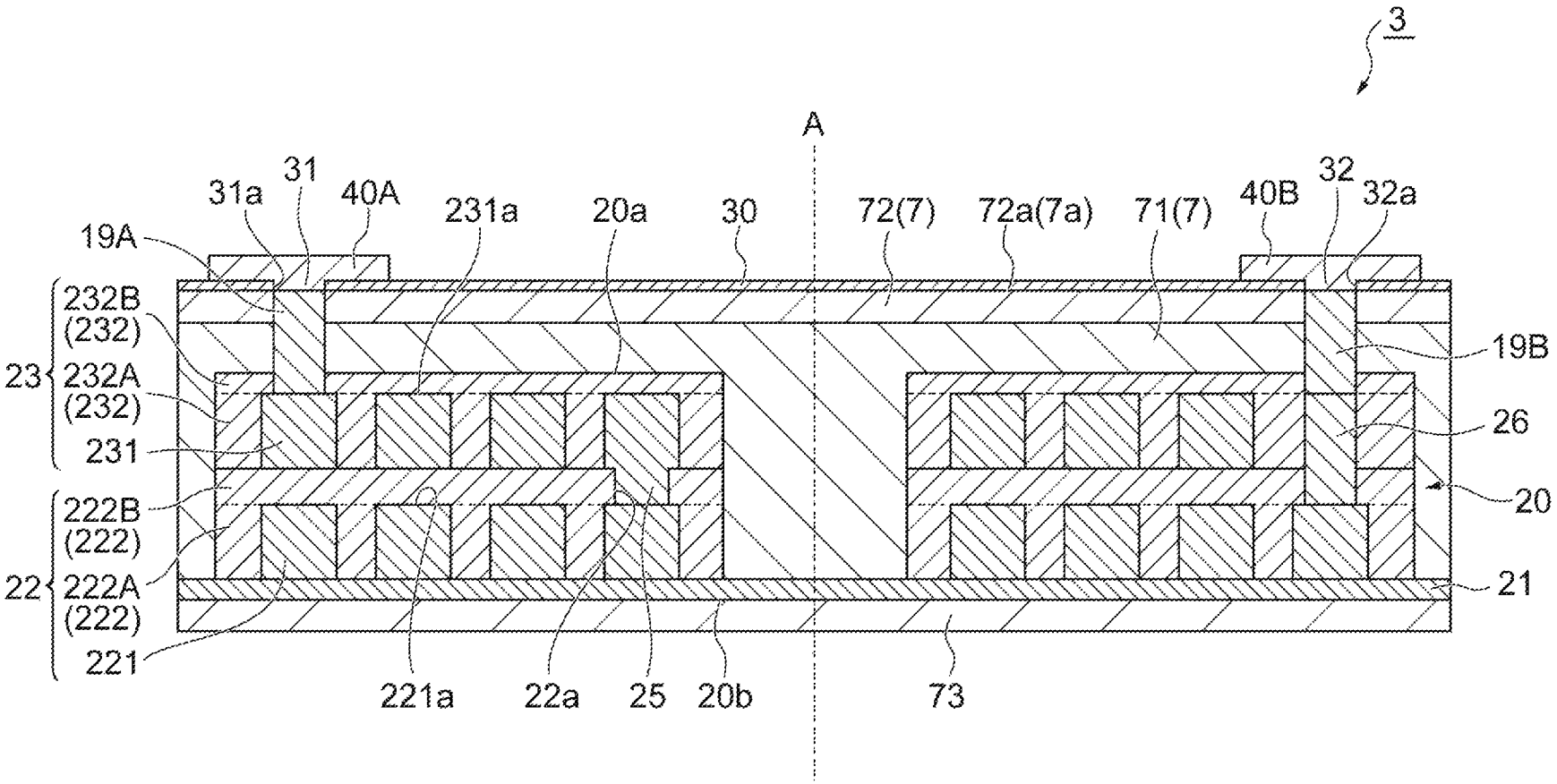
FIG. 10 is a sectional view schematically illustrating a coil component according to a modification.

Next, a coil component 3 according to a modification will be described with reference to FIG. 10. FIG. 10 is a sectional view schematically illustrating a coil component according to a modification. As illustrated in FIG. 10, like the coil component 1, the coil component 3 includes a coil part 20, a first magnetic resin layer 71, a second magnetic resin layer 72, conductor posts 19A and 19B, a cover insulating layer 30, and external terminals 40A and 40B. The coil component 3 is different from the coil component 1 in that a magnetic resin layer 7 further includes a third magnetic resin layer 73 that is laminated on a side opposite to the second magnetic resin layer 72 (a side opposite to a principal surface 20*a* of the coil part 20) with respect to the first magnetic resin layer 71. That is, the coil component 3 includes the third magnetic resin layer 73 included in the magnetic resin layer 7 in place of the magnetic substrate 10. The third magnetic resin layer is in contact with a principal surface 20*b* of the coil part 20.

Like the second magnetic resin layer 72, the third magnetic resin layer 73 is formed of a mixture that contains a magnetic filler and a binder resin (a resin). A constituent material of the magnetic filler contained in the third magnetic resin layer 73 is, for instance, iron, carbonyl iron, silicon, chromium, nickel, or boron. A constituent material of the binder resin is, for instance, an epoxy resin. A rate of the magnetic filler contained in the third magnetic resin layer 73 is, for instance, not less than 90 wt % of the entirety of the third magnetic resin layer 73. A rate of the binder resin contained in the third magnetic resin layer 73 is, for instance, not less than 3 wt % of the entirety of the third magnetic resin layer 73. A maximum particle size of the magnetic filler contained in the third magnetic resin layer 73 is smaller than that of the magnetic filler contained in the first magnetic resin layer 71, and is, for instance, not less than 1 μm and not more than 10 μm.

Next, a method of manufacturing the coil component 3 will be described. In the method of manufacturing the coil component 3, after the same process as in the method of manufacturing the coil component 1 is performed, the magnetic substrate 10 is removed by polishing or mechanical peeling. Afterward, a magnetic resin is applied to a surface exposed by the removal of the magnetic substrate 10 (the principal surface 20*b* of the coil part 20), and the third magnetic resin layer 73 is formed. Thereby, the coil component 3 illustrated in FIG. 10 is formed. In the method of manufacturing the coil component 3, without using the magnetic substrate 10 from the first process illustrated in FIG. 4A, a base material, polishing or peeling of which is easy, may be used.

In the coil component 3, like the coil component 1, since the second magnetic resin layer 72 containing a relatively fine magnetic filler is laminated on the first magnetic resin layer 71, the same effects as the coil component 1 can be obtained. In the coil component 3, the second magnetic resin layer 72 is provided close to the principal surface 20*a* of the coil part 20, and the third magnetic resin layer 73 containing a relatively fine magnetic filler is formed at a side opposite to the principal surface 20*a* of the coil part 20 (a side close to the principal surface 20*b*). Thus, symmetry of the coil component 3 in a laminating direction is improved. Therefore, a warp of the coil component 3 caused by stress or the like can be inhibited. In terms of the symmetry, the maximum particle size of the magnetic filler contained in the third magnetic resin layer 73 is preferably the same as that of the magnetic filler contained in the second magnetic resin layer 72.

Figure 11:
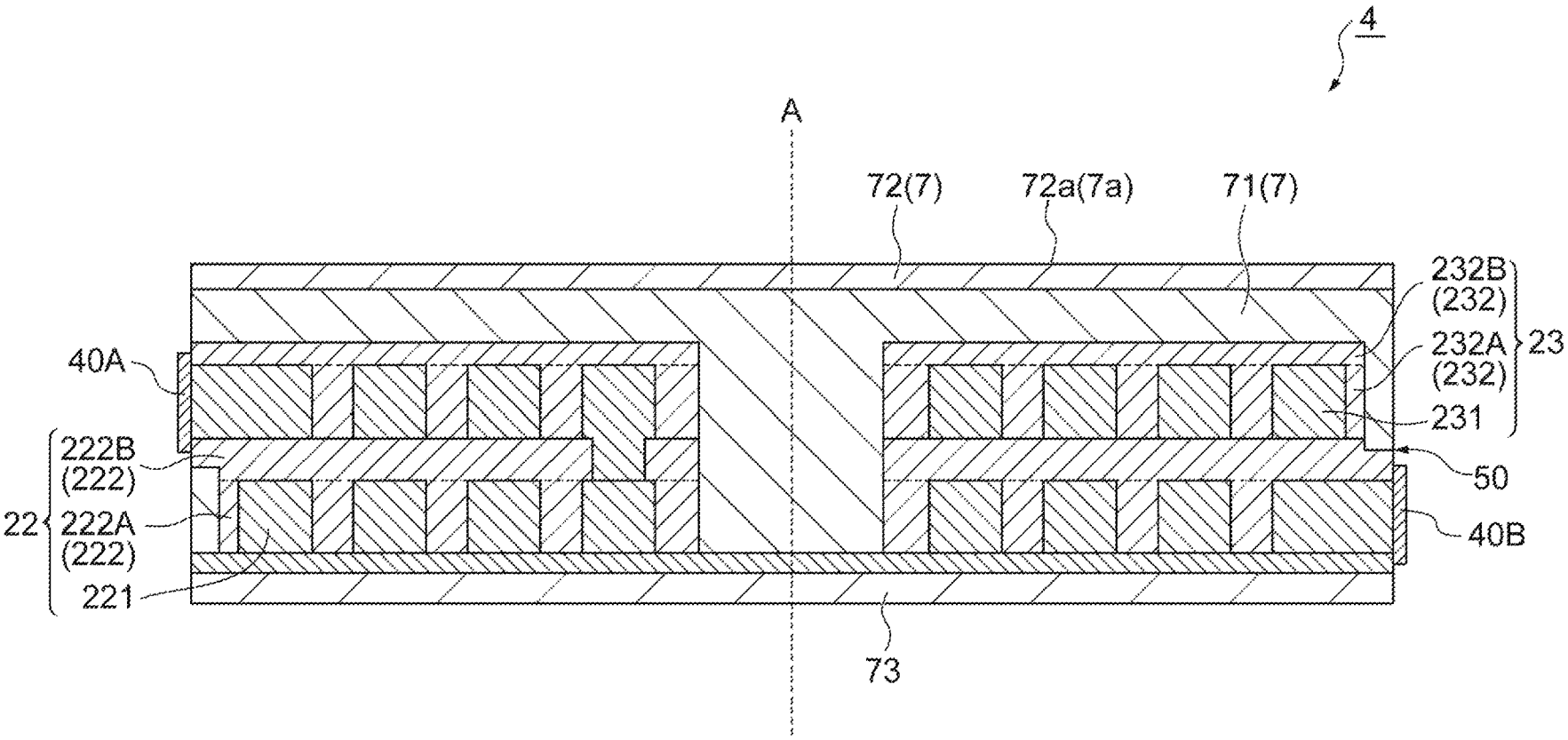
FIG. 11 is a sectional view schematically illustrating a coil component according to a modification of the coil component of FIG. 9.

Next, a coil component 4 according to a modification of the coil component 3 will be described with reference to FIG. 11. FIG. 11 is a sectional view schematically illustrating a coil component according to a modification. As illustrated in FIG. 11, like the coil component 3, the coil component 4 includes a first magnetic resin layer 71, a second magnetic resin layer 72, a third magnetic resin layer 73, and external terminals 40A and 40B. The coil component 4 is different from the coil component 3 in that it includes a coil part 50 in place of the coil part 20, and the external terminals 40A and 40B are provided on lateral surfaces thereof rather than one principal surface thereof.

In the coil part 50, an outermost end of a first winding section 221 and an outermost end of a second winding section 231 are exposed from lateral surfaces of the coil part 50. The lateral surfaces of the coil part 50 to which the first winding section 221 and the second winding section 231 are exposed are exposed from lateral surfaces of the first magnetic resin layer 71. That is, the outermost end of the first winding section 221 and the outermost end of the second winding section 231 are exposed on the lateral surfaces of the coil component 4. The external terminal 40A is provided on the lateral surface of the coil component 4 at a portion to which the second winding section 231 is exposed, and is directly electrically connected to the second winding section 231. The external terminal 40B is provided on the lateral surface of the coil component 4 at a portion to which the first winding section 221 is exposed, and is directly electrically connected to the first winding section 221.

Like the coil component 3, in the coil component 4, the second magnetic resin layer 72 is provided close to a principal surface 50*a* of the coil part 50, and the third magnetic resin layer 73 containing a relatively fine magnetic filler is provided at a side opposite to the principal surface 50*a* of the coil part 50 (a side close to a principal surface 20*b*). Therefore, the coil component 4 can also obtain the same effects as the coil component 3. Since no conductor posts are provided inside the first and second magnetic resin layers 71 and 72 in the coil component 4, a reduction in volumes of the first and second magnetic resin layers 71 and 72 due to the conductor posts can be inhibited.

While the embodiment of the present invention has been described, the present invention is not limited to the above embodiment, and can be variously modified. For example, in the above embodiment, the example in which the coil part 20 has the two winding sections (the first winding section 221 and the second winding section 231) has been described. The coil part 20 may have one winding section, or three or more winding sections.

What is claimed is:

1. A coil component comprising:

a base layer comprised of a magnetic material;

a coil part having (a) a lower insulating layer directly laminated on an entire surface of the base layer and (b) a planar coil (1) on a surface of the lower insulating layer that is on an opposite side of the lower insulating layer from the base layer and (2) that includes a winding section with a winding axis and an insulating section covering the winding section; and a magnetic resin layer (1) including a magnetic filler, (2) configured to cover the coil part, and (3) having a thickness of 10 μm-200 μm, wherein the magnetic resin layer has (a) a first magnetic resin layer that (1) includes a first magnetic filler and (2) is in contact with the coil part and (b) a second magnetic resin layer that (1) includes a second magnetic filler, (2) is laminated on the first magnetic resin layer on a side of the first magnetic resin layer opposite the coil part, and (3) has a thickness of 10 μm-20 μm, the second magnetic resin layer constitutes a principal surface of the magnetic resin layer on a side of the second magnetic resin layer opposite to the first magnetic resin layer, a maximum particle size of the second magnetic filler is smaller than a maximum particle size of the first magnetic filler, the insulating section is not magnetic, the insulating section covers an entirety of an outermost surface of the winding section, the outermost surface of the winding section being substantially parallel to the winding axis, and the first magnetic resin layer covers an entirety of an outermost surface of the coil part, the outermost surface of the coil part being substantially parallel to the winding axis.

2. The coil component according to claim 1, wherein the maximum particle size of the second magnetic filler is not more than 10% of a distance between a principal surface of the coil part which faces the magnetic resin layer in a laminating direction and the principal surface.

3. The coil component according to claim 1, wherein a thickness of the second magnetic resin layer is smaller than a distance between a principal surface of the coil part which faces the magnetic resin layer in a laminating direction and the principal surface of the magnetic resin layer.

4. The coil component according to claim 2, wherein a thickness of the second magnetic resin layer is smaller than a distance between a principal surface of the coil part which faces the magnetic resin layer in a laminating direction and the principal surface of the magnetic resin layer.

5. The coil component according to claim 1, wherein a thickness of the second magnetic resin layer is larger than or equal to a distance between a principal surface of the coil part which is close to the second magnetic resin layer in a laminating direction and a principal surface of the second magnetic resin layer which is located at a side opposite to the coil part.

6. The coil component according to claim 2, wherein a thickness of the second magnetic resin layer is larger than or equal to a distance between a principal surface of the coil part which is close to the second magnetic resin layer in a laminating direction and a principal surface of the second magnetic resin layer which is located at a side opposite to the coil part.

7. The coil component according to claim 1, wherein:

the magnetic resin layer has a third magnetic resin layer that is laminated on a side opposite to the second magnetic resin layer with respect to the first magnetic resin layer, and a maximum particle size of a magnetic filler contained in the third magnetic resin layer is smaller than that of the magnetic filler contained in the first magnetic resin layer.

8. The coil component according to claim 2, wherein:

the magnetic resin layer has a third magnetic resin layer that is laminated on a side opposite to the second magnetic resin layer with respect to the first magnetic resin layer, and a maximum particle size of a magnetic filler contained in the third magnetic resin layer is smaller than that of the magnetic filler contained in the first magnetic resin layer.

9. The coil component according to claim 3, wherein:

the magnetic resin layer has a third magnetic resin layer that is laminated on a side opposite to the second magnetic resin layer with respect to the first magnetic resin layer, and a maximum particle size of a magnetic filler contained in the third magnetic resin layer is smaller than that of the magnetic filler contained in the first magnetic resin layer.

10. The coil component according to claim 4, wherein:

the magnetic resin layer has a third magnetic resin layer that is laminated on a side opposite to the second magnetic resin layer with respect to the first magnetic resin layer, and a maximum particle size of a magnetic filler contained in the third magnetic resin layer is smaller than that of the magnetic filler contained in the first magnetic resin layer.

11. The coil component according to claim 5, wherein:

the magnetic resin layer has a third magnetic resin layer that is laminated on a side opposite to the second magnetic resin layer with respect to the first magnetic resin layer, and a maximum particle size of a magnetic filler contained in the third magnetic resin layer is smaller than that of the magnetic filler contained in the first magnetic resin layer.

12. The coil component according to claim 6, wherein:

the magnetic resin layer has a third magnetic resin layer that is laminated on a side opposite to the second magnetic resin layer with respect to the first magnetic resin layer, and a maximum particle size of a magnetic filler contained in the third magnetic resin layer is smaller than that of the magnetic filler contained in the first magnetic resin layer.

13. The coil component according to claim 1, further comprising:

an insulating layer covering the second magnetic resin layer; and an external electrode (1) on the insulating layer and (2) connected to the coil part.

14. The coil component according to claim 1, wherein the lower insulating layer is a separate layer from the planar coil.

15. The coil component according to claim 1, further comprising:

at least one external terminal on the principal surface; and a conductor post that extends between and electrically connects the winding section and the at least one external terminal through the first magnetic resin layer and the second magnetic resin layer.

16. The coil component according to claim 15, wherein the conductor post is directly above the winding part in a direction parallel to the winding axis.

17. The coil component according to claim 15, wherein the conductor post does not protrude through the insulating section and a portion of the first magnetic resin layer covering the outermost surface of the coil part.

18. The coil component according to claim 1, wherein the first magnetic resin layer is in direct contact with the outermost surface of the coil part.

19. The coil component according to claim 1, further comprising a cover insulating layer on the principal surface that has a portion between the principal surface and an external terminal connected to the winding section.

* * * * *